US009821329B2

(12) United States Patent
Chen

(10) Patent No.: US 9,821,329 B2
(45) **Date of Patent: *Nov. 21, 2017**

(54) AIR-CONDUCTIVE ROTARY SPRINKLER

(71) Applicant: Chin-Nan Chen, Keelung (TW)

(72) Inventor: Chin-Nan Chen, Keelung (TW)

( * ) Notice: Subject to any disclaimer, the term of this patent is extended or adjusted under 35 U.S.C. 154(b) by 279 days.

This patent is subject to a terminal disclaimer.

(21) Appl. No.: 14/681,728

(22) Filed: Apr. 8, 2015

(65) Prior Publication Data

US 2016/0001308 A1 Jan. 7, 2016

(30) Foreign Application Priority Data

Jul. 1, 2014 (TW) ..... 103122638 A

(51) Int. Cl.

| | |
|---|---|
| ***B05B 12/08*** | (2006.01) |
| ***B05B 3/04*** | (2006.01) |
| ***B05B 7/04*** | (2006.01) |
| ***B05B 15/02*** | (2006.01) |
| ***B05B 3/06*** | (2006.01) |
| ***B05B 7/24*** | (2006.01) |
| ***B08B 3/02*** | (2006.01) |

(52) U.S. Cl.

CPC ..... *B05B 3/0427* (2013.01); *B05B 3/06* (2013.01); *B05B 7/0416* (2013.01); *B05B 7/2435* (2013.01); *B05B 12/08* (2013.01); *B05B 15/02* (2013.01); *B08B 3/026* (2013.01); *B08B 2203/0217* (2013.01)

(58) Field of Classification Search

CPC ..... B05B 3/0427; B05B 3/06; B05B 7/0416; B05B 7/2435; B05B 12/08; B05B 15/02; B05B 3/026; B05B 2203/0217

USPC ..... 239/104

See application file for complete search history.

(56) References Cited

U.S. PATENT DOCUMENTS

| | | | | |
|---|---|---|---|---|
| 4,277,029 | A * | 7/1981 | Rabitsch | B05B 3/0454 239/232 |
| 4,760,959 | A * | 8/1988 | Gorney | B05B 3/0481 239/233 |
| 5,098,021 | A * | 3/1992 | Kah, Jr. | B05B 3/0431 239/231 |
| 5,267,689 | A * | 12/1993 | Forer | B05B 3/0454 239/11 |
| 5,330,103 | A * | 7/1994 | Eckstein | B05B 3/0431 239/240 |

(Continued)

*Primary Examiner* — Chee-Chong Lee

(74) *Attorney, Agent, or Firm* — Muncy, Geissler, Olds & Lowe, P.C.

(57) ABSTRACT

An air-conductive rotary sprinkler includes an air-conductive rotary sprinkling device, a fluid supply assembly and a dust-collecting cover. The air-conductive rotary sprinkling device further includes a main housing tube, an inner rotary tube and a rotary spray head. The rotary spray head includes a spray-head casing connected with the inner rotary tube and a guide plug installed inside the spray-head casing and further including a helical actuating groove, a helical conductive groove, a central channel and a sideway channel. The dust-collecting cover is assembled to the air-conductive rotary sprinkling device. The pressured airflow from the helical air channel rotates the rotary spray head, and the pressured airflow from the helical conductive channel also alters the spray direction of the fluid originally flowing along the base axis, such that the fluid can be sprayed out of the rotary spray head in a rotary manner.

7 Claims, 11 Drawing Sheets

(56) References Cited

U.S. PATENT DOCUMENTS

| | | | | | |
|---|---|---|---|---|---|
| 5,611,488 | A * | 3/1997 | Frolich | B05B 3/0436 | 239/242 |
| 5,772,117 | A * | 6/1998 | Su | B05B 3/0422 | 239/237 |
| 6,085,995 | A * | 7/2000 | Kah, Jr. | B05B 1/1645 | 239/237 |
| 6,164,562 | A * | 12/2000 | Wu | B05B 3/0436 | 137/625.44 |
| 6,651,904 | B2 * | 11/2003 | Roman | B05B 1/26 | 239/204 |
| 6,769,633 | B1 * | 8/2004 | Huang | B05B 1/262 | 239/457 |
| 7,156,322 | B1 * | 1/2007 | Heitzman | B05B 3/0454 | 137/625.11 |
| 7,255,291 | B1 * | 8/2007 | Lo | B05B 1/267 | 239/231 |

* cited by examiner

AIR-CONDUCTIVE ROTARY SPRINKLER

This application claims the benefit of Taiwan Patent Application Serial No. 103122638 filed on Jul. 1, 2014, the subject matter of which is incorporated herein by reference.

BACKGROUND OF INVENTION

1. Field of the Invention

The invention relates to an air-conductive rotary sprinkler, and more particularly to the sprinkler that introduces a helical actuating groove to rotate the rotary spray head and apply a jet flow from a sideway channel to change the spray direction of the fluid flowing along a base axis so as to rotary spray the fluid.

2. Description of the Prior Art

For ordinary cleaning work in the daily life, water is usually sprayed firstly onto a surface of the object to be cleaned, and then a brush or a napkin can be applied to wipe off the dirt on the surface. Such kind of cleaning work exhausts both the labor and the water resource.

Referring to FIG. 1, a schematic view of a conventional rotary liquid-spraying apparatus is shown. The conventional liquid-spraying apparatus PA100 includes a rotary liquid-spraying device PA1 and a liquid-providing assembly PA2, in which the rotary liquid-spraying device is mainly structured to have a bent flexible pipe PA12 to be installed inside a connection assembly PA11 in a rotary manner. The rotary liquid-spraying device PA1 is further coupled with a spray gun PA21, and the spray gun PA21 is further connects a liquid-supplying device PA22. Also, a conveying pipe PA13 is introduced to connect the bent flexible pipe PA12 into the liquid-supplying device PA22. Upon such an arrangement, when the spray gun PA21 outputs a gas, the liquid in the liquid-supplying device PA22 can be pumped out automatically through the bent flexible pipe PA12 and the conveying pipe PA13 in accordance with the Venturi effect. While the pumped-out liquid is then sprayed out through the bent flexible pipe PA12, since the bent flexible pipe PA12 is a curved pipe, the sprayed liquid will drive the bent flexible pipe PA12 to rotate, and thus a rotary liquid-spraying effect is achieved.

However, though the bent pipe can formulate a rotary spraying of the water, yet the manufacturing of the bent flexible pipe is comparably difficult and the assembling for the apparatus using the bent flexible pipe is much complicated. Inevitably, the cost for applying the bent flexible would be higher. Further, since the bent flexible pipe is a thin-shell metal pipe, thus it is vulnerable to be hit and deformed, by which ill spraying performance is inevitable.

SUMMARY OF THE INVENTION

As stated above, currently in the art, though the technology of the bent flexible pipe can contribute successfully to build a rotary spray pattern of the fluid, yet the manufacturing thereabout is much complicated, needs tedious assembling steps, and thus is less feasible. In addition, since the bent flexible pipe is a thin-shell metal pipe, thus it is vulnerable to be hit and deformed.

Accordingly, it is the primary object of the present invention to provide an air-conductive rotary sprinkler, that utilizes an airflow to drive a guide plug and a helical conductive groove and a sideway channel to change the spray direction of a fluid, such that the fluid can be sprayed in a rotary manner.

In the present invention, the air-conductive rotary sprinkler includes an air-conductive rotary sprinkling device and a fluid supply assembly. The air-conductive rotary sprinkling device includes a main housing tube, an inner rotary tube, a rotary spray head and a dust-collecting cover. The inner rotary tube rotationally about a base axis is located inside the main housing tube and further has an air-conveying channel. The rotary spray head includes a spray-head casing and a guide plug. The spray-head casing connected to the inner rotary tube further has an accommodation room communicative in space with the air-conveying channel. The guide plug mounted inside the accommodation room further includes a helical actuating groove, a helical conductive groove, a central channel and a sideway channel. The helical actuating groove is to pair with an inner wall of the spray-head casing so as to form in between a helical air channel communicative in space with the air-conveying channel. The helical conductive groove arranged in a symmetric manner with the helical actuating groove is paired with an inner wall of the spray-head casing to form in between a helical conductive channel communicative in space with the air-conveying channel. The central channel extended along the base axis is communicative in space with the air-conveying channel. The sideway channel extended along an air-injection direction crossing the base axis is communicated in space with the helical conductive groove.

The fluid supply assembly includes a spray gun and a fluid supply apparatus. The spray gun connected with the main housing tube supplies a pressured airflow into the air-conveying channel. The fluid supply apparatus connected with the spray gun further has a fluid-conveying pipe penetrating both the air-conveying channel and the central channel.

The dust-collecting cover is assembled to the air-conductive rotary sprinkling device.

In the present invention, the fluid in the fluid-conveying pipe is blown to spray out along the base axis by the pressured airflow injected from the central channel. The pressured airflow injected from the helical air channel is to rotate the rotary spray head. Further, the pressured airflow is injected from the helical conductive channel to alter the spray direction of the fluid originally flowing along the base axis so as to spray the fluid out of the rotary spray head in a rotary manner.

In one embodiment of the present invention, the air-conductive rotary sprinkling device can further include a bearing having an inner ring sleeved onto the inner rotary tube and an outer ring sleeved into the main housing tube.

In one embodiment of the present invention, the air-conductive rotary sprinkling device can further include an extension tube and a guide pipe, in which the extension tube is connected with the main housing tube and the fluid supply assembly, and the guide pipe connected with the extension tube penetrates the inner rotary tube. Also, the guide pipe allows the fluid-conveying pipe to penetrate.

In one embodiment of the present invention, the dust-collecting cover further includes a main cover body fixed to the main housing tube. Preferably, the dust-collecting cover can further includes a tightening member for tightly fixing the dust-collecting cover to the main housing tube.

In summary, since the present invention utilizes the helical actuating groove and the helical conductive groove of the guide plug to form the helical air channel and the helical conductive channel respectively with the spray-head casing, so, while the pressured airflow flows through the helical air channel and the helical conductive channel, the rotary spray head would be driven to rotate. Further, the pressured airflow from the sideway channel communicative in space with the helical conductive groove can be injected by targeting the base axis in an oblique manner, such that the spray direction of the fluid out of the central channel can be altered so as to formulate a rotary spraying out of the rotary spray head in a rotary manner. In addition, since the present invention further provides the dust-collecting cover to connect a vacuum, so the dusts or particles disturbed or produced by the spraying liquid can be removed by the vacuum flow through the dust-collecting cover, such that the clean efficiency can be enhanced.

All these objects are achieved by the air-conductive rotary sprinkler described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to an air-conductive rotary sprinkler. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
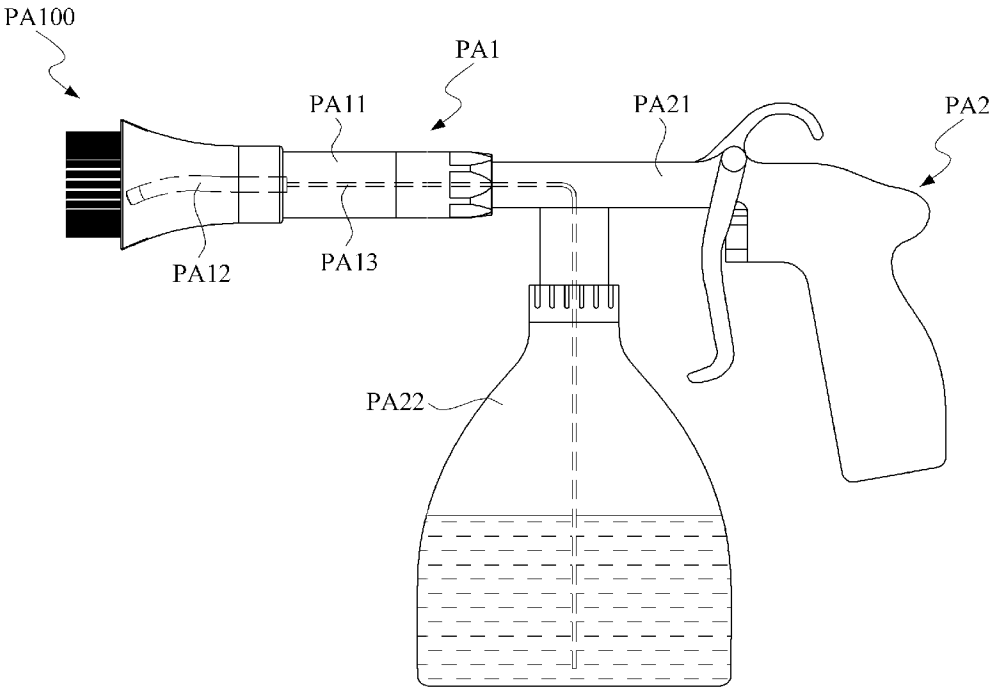
FIG.1(Prior Art)
FIG. 1 is a schematic view of a conventional rotary liquid-spraying apparatus.
Figure 2:
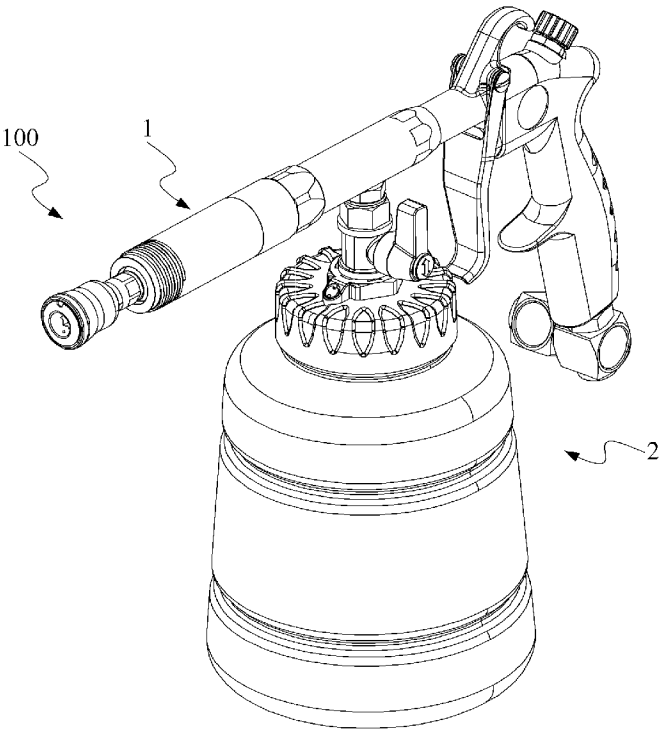
FIG. 2 is a schematic perspective view of a first embodiment of the air-conductive rotary sprinkler in accordance with the present invention.
Figure 3:
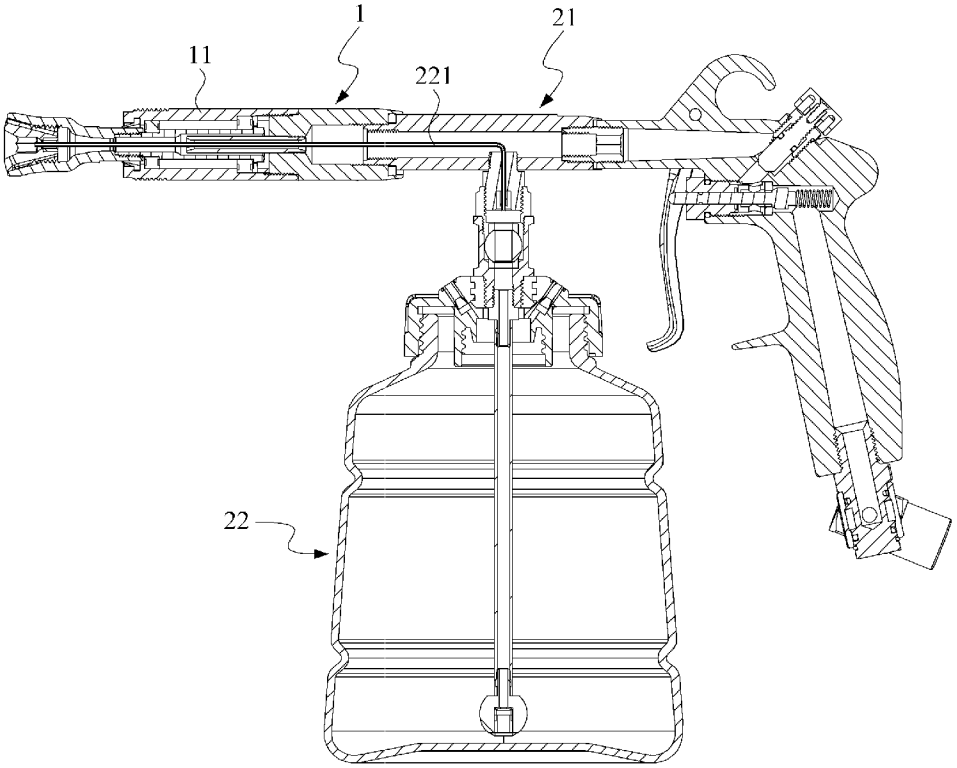
FIG. 3 is a schematic cross-sectional view of FIG. 2.
Figure 4:
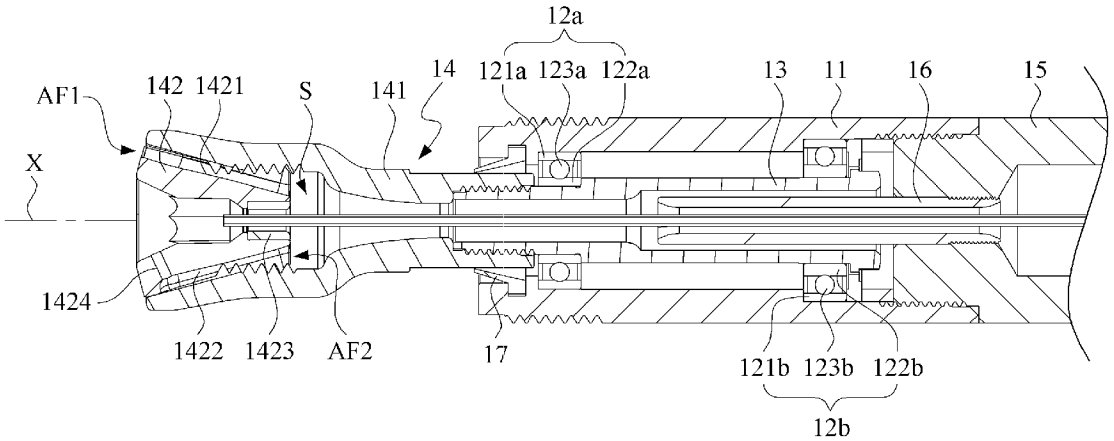
FIG. 4 is an enlarged view upon a portion of FIG. 3.
Figure 5:
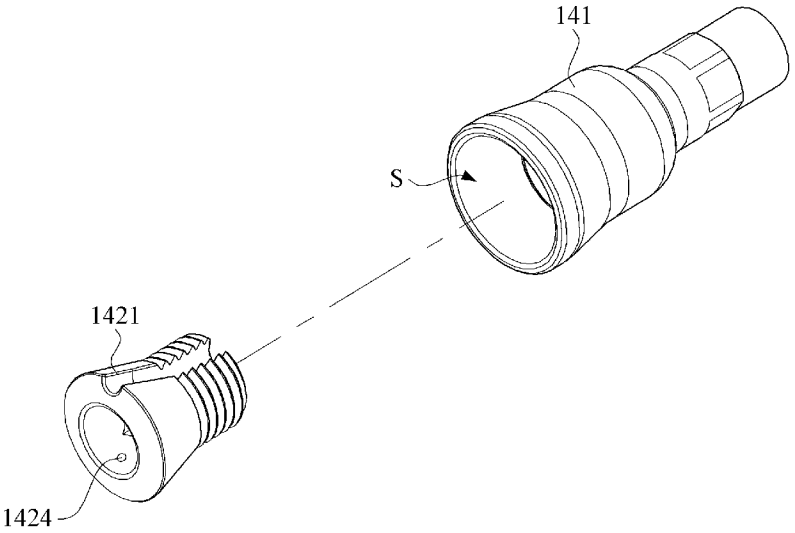
FIG. 5 is a schematic exploded view of a spray-head casing and a guide plug for the air-conductive rotary sprinkler of FIG. 2.

Refer now to FIG. 2 through FIG. 5, in which FIG. 2 is a schematic perspective view of a first embodiment of the air-conductive rotary sprinkler in accordance with the present invention, FIG. 3 is a schematic cross-sectional view of FIG. 2, FIG. 4 is an enlarged view upon a portion of FIG. 3, and FIG. 5 is a schematic exploded view of a spray-head casing and a guide plug for the air-conductive rotary sprinkler of FIG. 2.

As shown, the air-conductive rotary sprinkler 100 includes an air-conductive rotary sprinkling device 1 and a fluid supply assembly 2.

The air-conductive rotary sprinkling device 1 includes a main housing tube 11, two bearings 12*a* and 12*b*, an inner rotary tube 13, a rotary spray head 14, an extension tube 15, a guide pipe 16 and a dusk-proof ring 17. The bearing 12*a* includes an outer ring 122*a*, an inner ring 122*a* and a plurality of balls 123*a*. The outer ring 121*a* is sleeved into the main housing tube 11, the inner ring 122*a* is located inner to the outer ring 121*a* in a rotary manner, and the balls 123*a* are free to roll in the ring space form between the inner ring 122*a* and the outer ring 121*a*, such that the inner ring 122*a* can be relatively rotational with respect to the outer ring 122*b* as well as the balls 123*b*. The bearing 12*b* is similar to the bearing 12*a* in structuring, and thus details for the bearing 12*b* are omitted herein.

By providing the two bearings 12*a* and 12*b* to support the inner rotary tube 13 at both ends thereof inside the main housing tube 11, so that the inner rotary tube 13 can thus perform shaft rotation about the base axis X inside the fixed main housing tube 11. The inner rotary tube 13 further has an air-conveying channel (not labeled in the figure).

The rotary spray head 14 includes a spray-head casing 141 and a guide plug 142. The spray-head casing 141 screwed to engage the inner rotary tube 13 further has an accommodation room S communicative in space with the air-conveying channel.

The guide plug 142 screwed to mount inside the accommodation room S further has a helical actuating groove 1421, a helical conductive groove 1422, a central channel 1423 and a sideway channel 1424.

The helical actuating groove 1421 is paired with an inner wall of the spray-head casing 141 so as to form a helical air channel AF1 communicative in space with the air-conveying channel. The helical conductive groove 1422 located in a symmetric manner with the helical actuating groove 1421 is paired with an inner wall of the spray-head casing 141 so as to form a helical conductive channel AF2 communicative in space with the air-conveying channel.

The central channel 1423 extends along the base axis X and is communicative in space with the air-conveying channel. The sideway channel 1424 extends along an air-injection direction FD (labeled in FIG. 6) crossing the base axis X and is communicative in space with the helical conductive groove 1422.

The extension tube 15 engage with the main housing tube 11 and the fluid supply assembly 2 by a screwing manner. The guide pipe 16 is screwed to connect the extension tube 15 and penetrates through the inner rotary tube 13. Also, the fluid-conveying pipe 221 penetrates the guide pipe 16

The dust-proof ring 17 is sleeved onto a front end of the fixed main housing tube 11 and contacts elastically at the spray-head casing 141, such that foreign dusts or particles can be prevented from entering the fixed main housing tube 11. Thus, the rotation of the bearings 12*a* and 12*b* can be ensured.

The fluid supply assembly 2 includes a spray gun 21 and a fluid supply apparatus 22. The spray gun 21 engages the main housing tube 11 so as to send a pressured airflow into the air-conveying channel. The fluid supply apparatus 22 is connected with the spray gun 21 and has a fluid-conveying pipe 221 penetrating through both the air-conveying channel and the central channel 1423.

Figure 6:
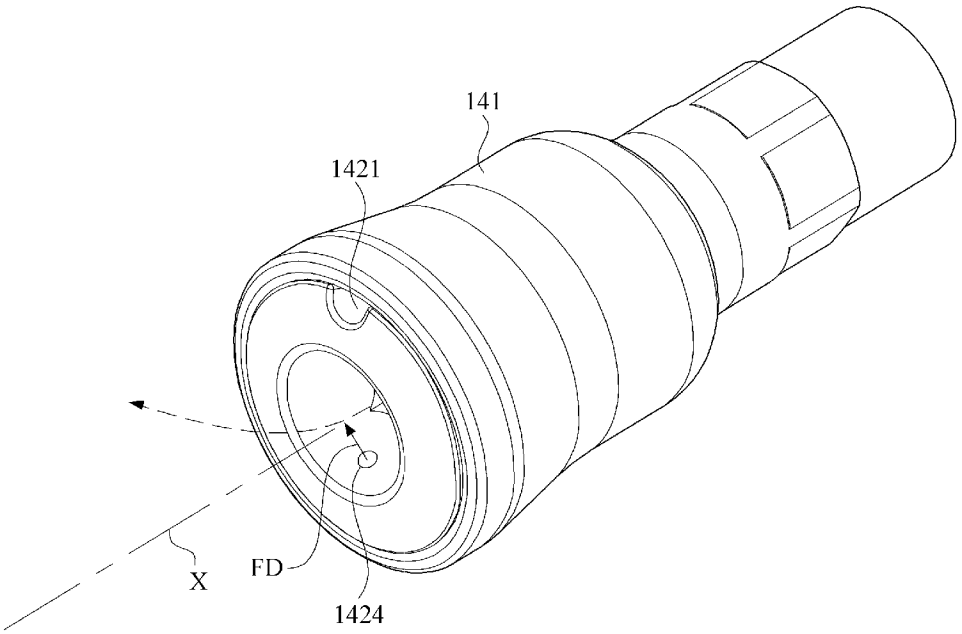
FIG. 6 demonstrates the spray direction change of the fluid at the rotary spray head, affected by a pressured airflow injected from a sideway channel.
Figure 7:
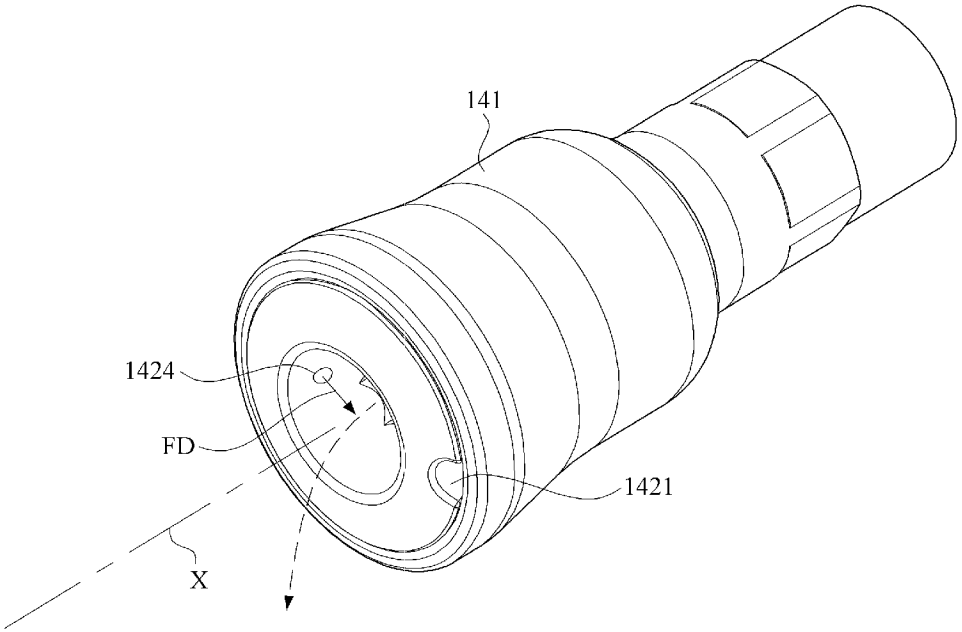
FIG. 7 demonstrates another angling of the rotary spray head, driven by the pressured airflow.

Refer now to FIG. 4, FIG. 6 and FIG. 7, in which FIG. 6 demonstrates the spray direction change of the fluid at the rotary spray head affected by a pressured airflow injected from a sideway channel, and FIG. 7 demonstrates another angling of the rotary spray head driven by the pressured airflow.

As shown, the fluid in the fluid-conveying pipe 221 would be driven by the pressured airflow from the central channel 1423 to spray out of the pipe along the base axis X. The pressured airflow from the helical air channel AF1 drives the rotary spray head 14 to rotate. The pressured airflow from the helical conductive channel AF2 is introduced to alter the spray direction of the fluid originally flowing along the base axis X so as to spray the fluid out of the rotary spray head 14 in a rotary manner. As shown in FIG. 6 and FIG. 7, while the pressured airflow from the helical air channel AF1 rotates the rotary spray head 14, the spray direction of the fluid is simultaneously affected by the pressured airflow from the helical conductive channel AF2. Further, the rotation of the rotary spray head 14 would be in a rotary spraying pattern.

As stated above in the background section, currently in the art, though the technology of the bent flexible pipe can contribute successfully to build a rotary spraying pattern of the fluid, yet the manufacturing thereabout is much complicated and vulnerable to be distorted by foreign forcing, and also the apparatus using the bent flexible pipe needs tedious assembling steps. On the other hand, the present invention utilizes the helical actuating groove 1421 and the helical conductive groove 1422 of the guide plug to pair corresponding inner walls of the spray-head casing 141 so as to form the helical actuating channel AF1 and the helical conductive channel AF2, respectively. Thereby, the pressured airflows flowing through the helical actuating channel AF1 and the helical conductive channel AF2 can be injected to drive the rotary spray head 14. Further, the pressured airflow from the sideway channel 1424 communicative in space with the helical conductive groove 1421 can be injected by targeting the base axis in an oblique manner, such that the spray direction of the fluid out of the central channel 1423 can be altered so as to formulate a rotary spraying. For the present invention does not apply the bent flexible pipe to formulate the rotary spraying, thus the present invention can simplify the manufacturing, reduce the cost, and provide a solid structure to increase the stability and the endurance.

Figure 8:
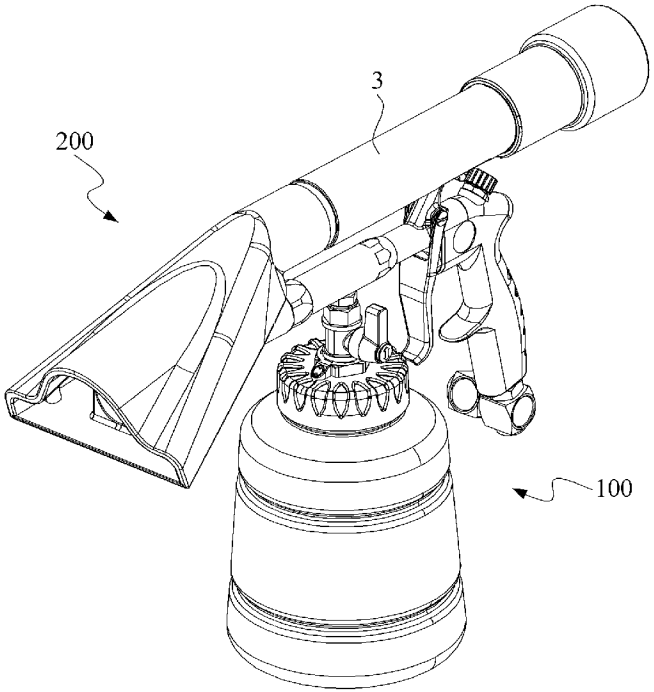
FIG. 8 is a schematic perspective view of a second embodiment of the air-conductive rotary sprinkler in accordance with the present invention.
Figure 9:
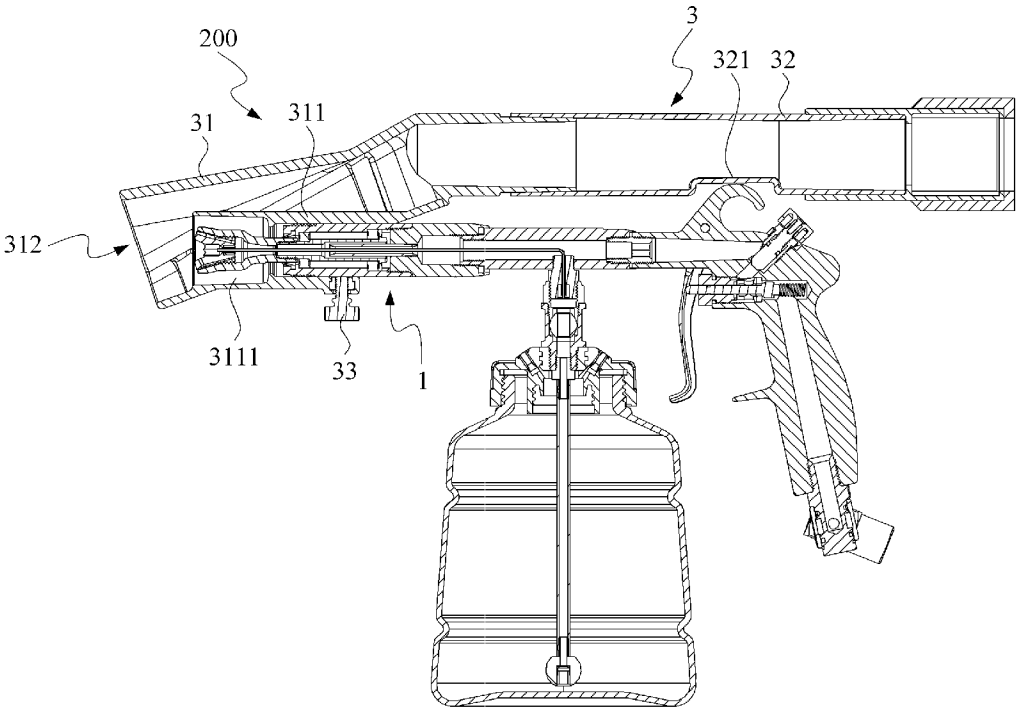
FIG. 9 is a schematic cross-sectional view of FIG. 8.

Refer now to FIG. 3, FIG. 4, FIG. 8 and FIG. 9, in which FIG. 8 is a schematic perspective view of a second embodiment of the air-conductive rotary sprinkler in accordance with the present invention, and FIG. 9 is a schematic cross-sectional view of FIG. 8. As shown, compared to the aforesaid first embodiment of the air-conductive rotary sprinkler 100, this second embodiment of the air-conductive rotary sprinkler 200 further includes a dust-collecting cover 3. The dust-collecting cover 3 includes a main cover body 31, a connection pipe 32 and a tightening member 33. In particular, the dust-collecting cover 3 of this second embodiment is a divergent-type dust-collecting cover.

The main cover body 31 has an accommodation portion 311 and a suck-in opening 312, in which the accommodation portion 311 is to couple the main housing tube 11 of the air-conductive rotary sprinkling device 1 and provides an accommodation room 3111 for accommodating thereinside the rotary spray head 14. The tightening member 33 is to fix the main housing tube 11 firmly to the accommodation portion 311. In this embodiment, the tightening member 33 is screwed to fix the main housing tube 11.

The connection pipe 32 connected with the main cover body 31 is extended for further connecting a vacuum pipe. The connection pipe 32 has a dent portion 321 for accommodating a hook (not labeled in the figure) of the spray gun 21. In practice, since the air-conductive rotary sprinkler 200 has the dust-collecting cover 3 having the connection pipe 32 to connect further a vacuum, so the air flow injected by the air-conductive rotary sprinkling device 1 as well as the dust disturbed by the air flow can be sucked away so as to provide immediate cleanness and convenience.

Figure 10:
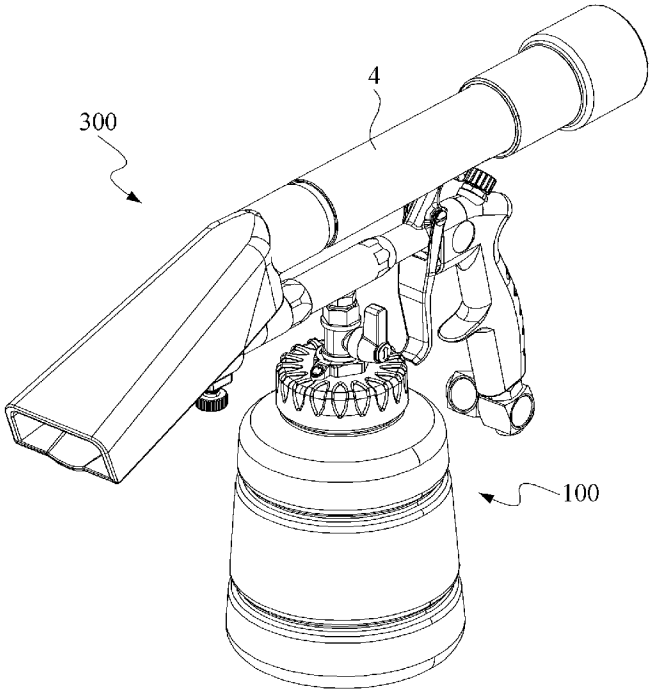
FIG. 10 is a schematic perspective view of a third embodiment of the air-conductive rotary sprinkler in accordance with the present invention.
Figure 11:
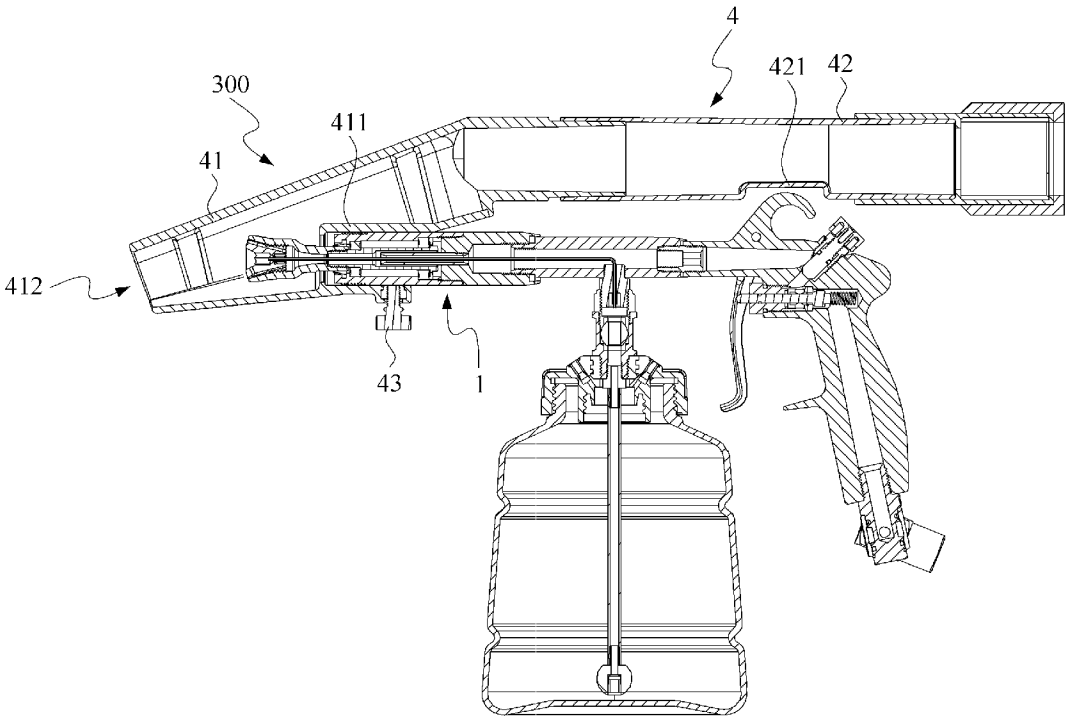
FIG. 11 is a schematic cross-sectional view of FIG. 10.

Refer now to FIG. 3, FIG. 4, FIG. 10 and FIG. 11, in which FIG. 10 is a schematic perspective view of a third embodiment of the air-conductive rotary sprinkler in accordance with the present invention, and FIG. 11 is a schematic cross-sectional view of FIG. 10. As shown, compared to the aforesaid first embodiment of the air-conductive rotary sprinkler 100, this third embodiment of the air-conductive rotary sprinkler 300 further includes a dust-collecting cover 4. The dust-collecting cover 4 includes a main cover body 41, a connection pipe 42 and a tightening member 43. In particular, the dust-collecting cover 4 of this second embodiment is a convergent-type dust-collecting cover.

The main cover body 41 has an accommodation portion 411 and a suck-in opening 412, in which the accommodation portion 411 is to couple the main housing tube 11 of the air-conductive rotary sprinkling device 1. The tightening member 43 is to fix the main housing tube 11 firmly to the accommodation portion 411. In this embodiment, the tightening member 43 is screwed to fix the main housing tube 11.

The connection pipe 42 connected with the main cover body 41 is extended for further connecting a vacuum pipe. The connection pipe 42 has a dent portion 421 for accommodating a hook (not labeled in the figure) of the spray gun 21. In practice, since the air-conductive rotary sprinkler 300 has the dust-collecting cover 4 having the connection pipe 42 to connect further a vacuum, so the air flow injected by the air-conductive rotary sprinkling device 1 as well as the dust disturbed by the air flow can be sucked away so as to provide immediate cleanness and convenience.

In addition, the aforesaid air-conductive rotary sprinkler 200 includes the accommodation room 3111 to accommodate the rotary spray head 14, such that the vacuum flow through the dust-collecting cover 3 can bypass the rotary spray head 14 and thus possible contamination to the rotary spray head 14 can be reduced to a minimum. On the other hand, the air-conductive rotary sprinkler 300 is to accommodate the rotary spray head 14 directly inside the main cover body 41, such that the volume of the suck-in opening 412 can be reduced and thus the vacuum range of the dust-collecting cover 4 can be much focused.

While the present invention has been particularly shown and described with reference to a preferred embodiment, it will be understood by those skilled in the art that various changes in form and detail may be without departing from the spirit and scope of the present invention.

What is claimed is:

1. An air-conductive rotary sprinkler, comprising:

an air-conductive rotary sprinkling device, including:

a main housing tube;

an inner rotary tube, rotationally mounted inside the main housing tube about a base axis, having an air-conveying channel; and a rotary spray head, including:

a spray-head casing, connected with the inner rotary tube, having an accommodation room communicative in space with the air-conveying channel; and a guide plug, installed inside the accommodation room, including:

a helical actuating groove, pairing an inner wall of the spray-head casing to form a helical air channel communicative in space with the air-conveying channel;

a helical conductive groove, located symmetrically with respect to the helical actuating groove, pairing another inner wall of the spray-head casing to form a helical conductive channel communicative in space with the air-conveying channel;

a central channel, extending along the base axis and being communicative in space with the air-conveying channel; and a sideway channel, extending along an air-injection direction crossing the base axis and being communicative in space with the helical conductive groove; and a fluid supply assembly, including:

a spray gun, engaging the main housing tube for providing a pressured airflow into the air-conveying channel; and a fluid supply apparatus, connected with the spray gun, having a fluid-conveying pipe penetrating the air-conveying channel and the central channel for conveying a fluid; and a dust-collecting cover, assembled to the air-conductive rotary sprinkling device;

wherein the fluid in the fluid-conveying pipe flowing out is driven to spray out of the fluid-conveying pipe along the base axis by the pressured airflow injected from the central channel, the rotary spray head is driven to rotate by the pressured airflow injected from the helical air channel, the spray direction of the fluid flowing originally along the base axis is altered by the pressured airflow injected from the helical conductive channel, and thus the fluid is sprayed out of the rotary spray head in a rotary manner.

2. The air-conductive rotary sprinkler of claim 1, wherein the air-conductive rotary sprinkling device further includes a bearing having an inner ring sleeved onto the inner rotary tube and an outer ring sleeved into the main housing tube.

3. The air-conductive rotary sprinkler of claim 1, wherein the air-conductive rotary sprinkling device further includes an extension tube and a guide pipe, in which the extension tube is connected with the main housing tube and the fluid supply assembly, the guide pipe connected with the extension tube penetrates the inner rotary tube, and the guide pipe allows the fluid-conveying pipe to penetrate.

4. The air-conductive rotary sprinkler of claim 1, wherein the dust-collecting cover further includes a main cover body fixed to the main housing tube.

5. The air-conductive rotary sprinkler of claim 1, wherein the dust-collecting cover further includes a tightening member for tightly fixing the dust-collecting cover to the main housing tube.

6. The air-conductive rotary sprinkler of claim 1, wherein the dust-collecting cover is a divergent-type dust-collecting cover.

7. The air-conductive rotary sprinkler of claim 1, wherein the dust-collecting cover is a convergent-type dust-collecting cover.

* * * * *